US006161653A

United States Patent [19]

Skalski et al.

[11] Patent Number: 6,161,653

[45] Date of Patent: Dec. 19, 2000

[54] ROPELESS GOVERNOR MECHANISM FOR AN ELEVATOR CAR

[75] Inventors: Clement Alexander Skalski, Avon, Conn.; Richard Calcasola, Longmeadow, Mass.; Samuel C. Wan, Simsbury, Conn.

[73] Assignee: Otis Elevator Company, Farmington, Conn.

[21] Appl. No.: 09/218,991

[22] Filed: Dec. 22, 1998

[51] Int. Cl.[7] ..... B66B 5/04

[52] U.S. Cl. ..... 187/305; 187/373; 187/288; 187/376; 188/188

[58] Field of Search ..... 187/288, 305, 187/358, 373–376; 188/188, 189

[56] References Cited

U.S. PATENT DOCUMENTS

| | | | |
|---|---|---|---|
| 4,538,706 | 9/1985 | Koppensteiner | 187/376 |
| 4,662,481 | 5/1987 | Morris et al. | 187/77 |
| 4,819,765 | 4/1989 | Winkler et al. | 187/376 |
| 5,052,523 | 10/1991 | Ericson | 187/89 |
| 5,065,845 | 11/1991 | Pearson | 187/89 |
| 5,096,020 | 3/1992 | Korhonen | 187/376 |
| 5,224,570 | 7/1993 | Fromberg | 187/376 |
| 5,323,877 | 6/1994 | Mori | 187/91 |
| 5,377,786 | 1/1995 | Nakagawa | 187/276 |
| 5,487,450 | 1/1996 | Gerber | 187/367 |
| 5,628,385 | 5/1997 | Yumura et al. | 187/373 |
| 5,648,644 | 7/1997 | Nagel | 187/288 |
| 5,648,645 | 7/1997 | Arpagaus et al. | 187/393 |
| 6,003,636 | 12/1999 | Yumura | 187/376 |

FOREIGN PATENT DOCUMENTS

| | | |
|---|---|---|
| 0712804 | 5/1996 | European Pat. Off. . |
| 0543154 | 9/1997 | European Pat. Off. . |
| 0812796 | 12/1997 | European Pat. Off. . |
| 0856485 | 1/1998 | European Pat. Off. . |
| 0841282 | 5/1998 | European Pat. Off. . |
| 0662445 | 4/1999 | European Pat. Off. . |
| 198 255 | 4/1907 | Germany . |
| 3934492 | 4/1990 | Germany . |
| 3124688 | 5/1991 | Japan . |
| 4246079 | 9/1992 | Japan . |
| 4365771 | 12/1992 | Japan . |
| 5147852 | 6/1993 | Japan . |
| 5262472 | 10/1993 | Japan . |
| 6255949 | 9/1994 | Japan . |
| 8198543 | 8/1996 | Japan . |
| 9040317 | 2/1997 | Japan . |
| WO9842610 | 10/1998 | WIPO . |

OTHER PUBLICATIONS

Otis Invention Disclosure No. OT–4556 entitled Mechanical Resetting for Switch (Apolo Governor) dated Apr. 27, 1999.

*Primary Examiner*—Robert P. Olszewski
*Assistant Examiner*—Thuy V. Tran

[57] ABSTRACT

A ropeless governor system is provided for governing the speed of an elevator car (2) in the event of an overspeed condition. An actuator for a safety device (30) is positioned in close proximity to an elevator rail (14) and activated to come into contact and provide a dragging force against the rail in the event of an overspeed condition. The ropeless governor is coupled to an elevator safety braking system (26, 28) such that the dragging force activates the safety brakes. A safety controller (91) is used to determine if the speed of the elevator car has exceeded a predetermined threshold level and to produce a triggering signal (96) to operate the ropeless governor.

4 Claims, 5 Drawing Sheets

FIG.2
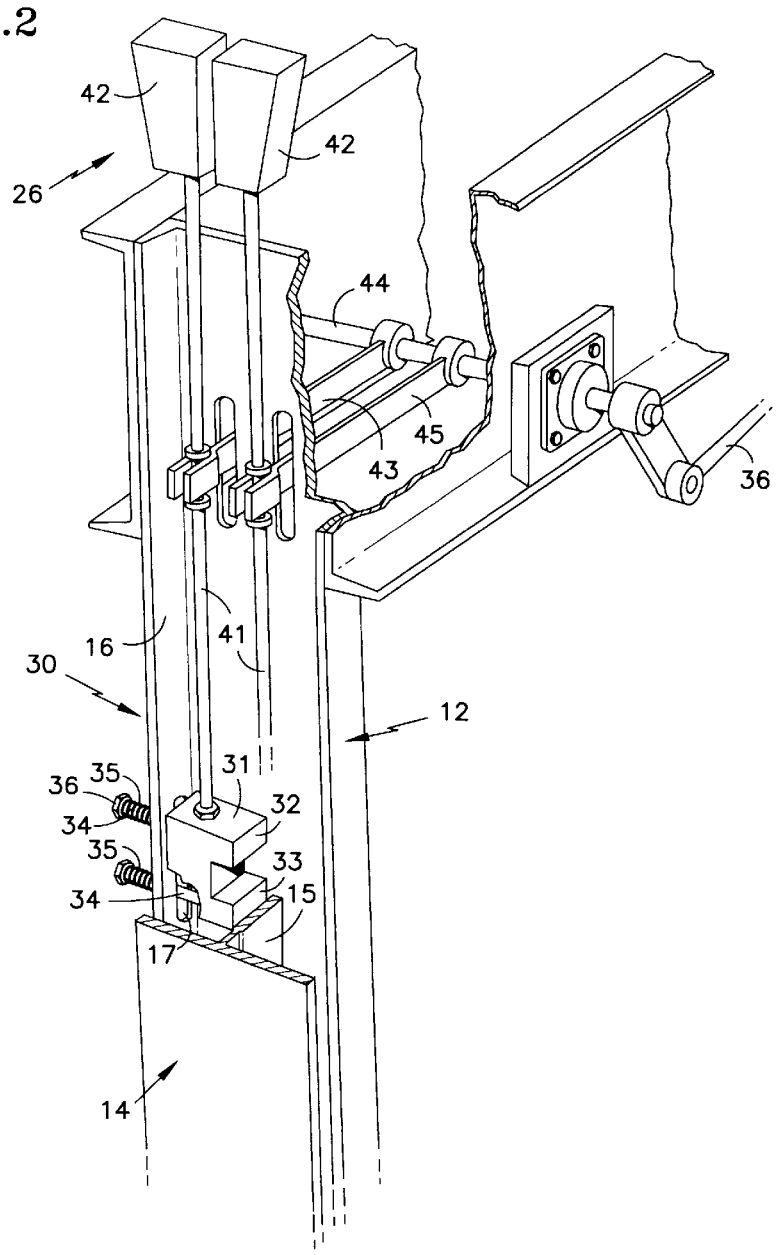
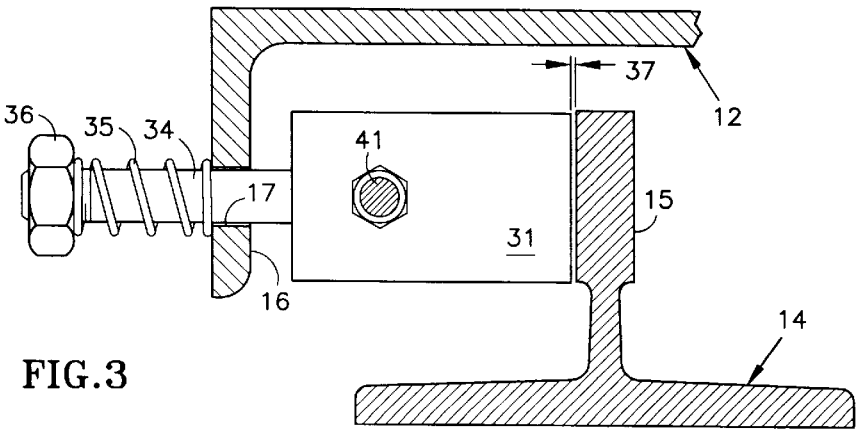
FIG.3

FIG.8
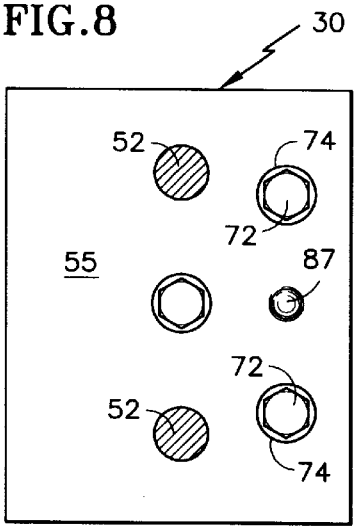
FIG.9
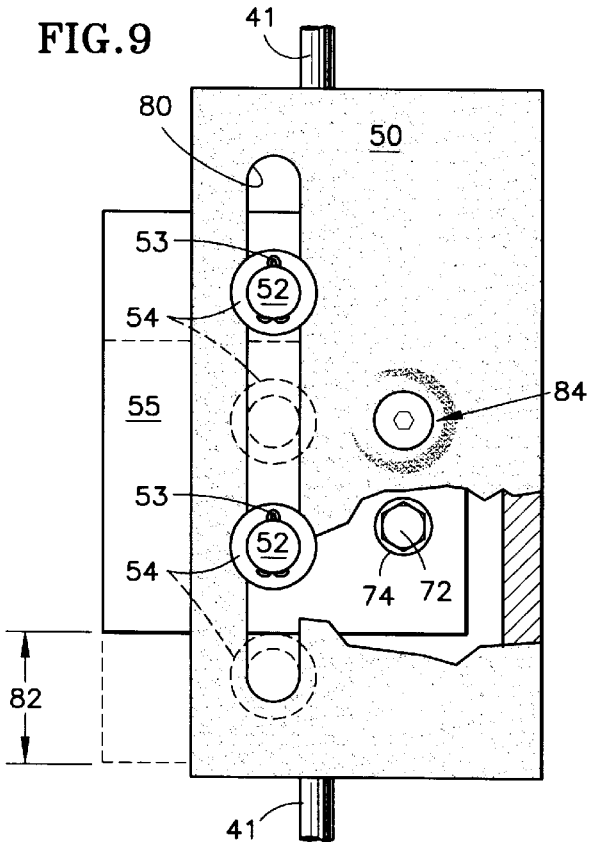
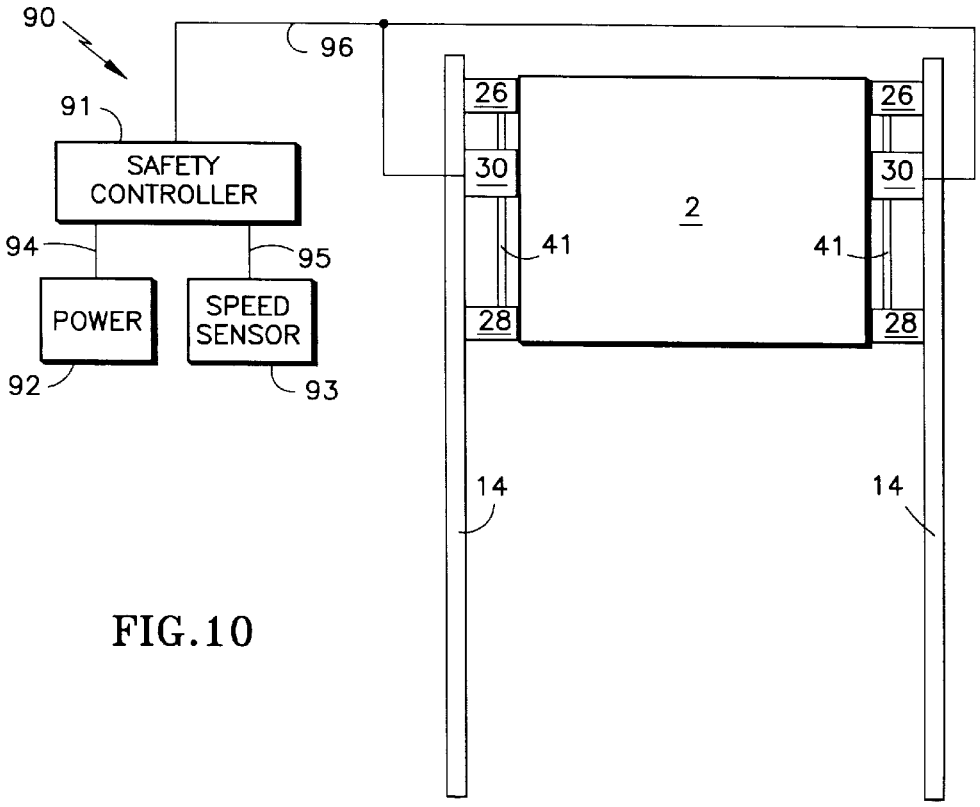
FIG.10

ROPELESS GOVERNOR MECHANISM FOR AN ELEVATOR CAR

TECHNICAL FIELD

The present invention relates to an actuation mechanism for an elevator car, and more particularly to an electromagnetic overspeed brake actuation mechanism.

BACKGROUND OF THE INVENTION

Elevator systems are typically guided between a pair of ferrous rails, such as steel, which are also used as braking surfaces for emergency stops. In normal operation, all of the motion of the elevator and all of the arresting of that motion is caused by the hoist ropes, which are moved upwardly and downwardly, or held in a fixed position by means of a sheave, the motion of the sheave being controlled by the elevator drive motor and the machine brake which are mechanically coupled to the sheave. Machine brakes typically are spring actuated into the braking position against a drum or a disk attached to the sheave, and use electromagnets to release the brakes from the braking position when the elevator is to move. This provides fail-safe braking insofar as electrical power or electronic signaling is concerned.

In a typical elevator system a governor rope is attached to the elevator and rotates a governor, at a rate of rotary speed that relates to the elevator's linear speed, which has fly weights that move outwardly with increasing speed as a result of centrifugal force. When the elevator exceeds a predetermined speed by some small percent, the fly weights will be displaced sufficiently outward to trip an overspeed switch and release a latch which allows a jaw to grip the governor rope and arrest its motion. The arrested governor rope causes actuators to pull safety rods on the elevator car causing the operation of safety brakes (sometimes called "safeties"), which are typically wedges that become jammed between a safety block and opposite sides of the of the elevator guide rail causing an increasing frictional force which abruptly stops the elevator car.

German patent, No. 198,255 suggested using electromagnets as an elevator safety brake, which would engage as a result of cable breakage, slackening of cable tension or exceeding predetermined speeds. Braking action is due both to mechanical friction and electromotive force generated in the car's guidance rail. A battery is used, and the operational capability of the system is tested with a switch each time that the elevator comes to rest. Similar eddy current braking systems have been devised for railroad trains, one example of which is shown in a pamphlet entitled "Eddy Current Brake WSB", published by Knorr-Bremse GMBH, 1975. The system described therein has electromagnets of alternating polar orientation dispersed above a length of track, on a carrier which hangs directly from the railway car truck. The magnets are kept suspended away from the rails by pneumatic cylinders except when emergency braking is desired; then, the air pressure is released so that the brake can drop down on the rail, thereby providing frictional braking action as a consequence of the electromagnetic attraction of the electromagnets to the rail, as well as magnetodynamic braking as a consequence of eddy currents induced by the alternating magnetic poles traversing the material of the track.

Other prior art elevators use a passive magnetodynamic car safety brake having permanent magnets arranged with alternate magnetic polarity. As the magnets pass a ferrous member an electromotive field is produced. The safety brake operates safety rods pulling a brake shoe arrangement into engagement with a surface used for braking. Such systems can provide safety braking action for either direction of travel of the elevator car. In this particular embodiment the need for a rope assembly governor is eliminated.

Another overspeed brake of the prior art which does not require a rope assembly governor uses a magnet mounted on the elevator which induces an eddy current in the conductive vane which in turn produces an electromagnetic reaction force on the magnet, causing the magnet to actuate a brake, thereby braking the elevator car at any vertical point between the hoist way terminals.

DISCLOSURE OF THE INVENTION

The present invention is an improved method and apparatus for activating the safety brake of a moving elevator car without the use of a rope assembly governor.

In accordance with the present invention, a friction brake is mounted to an elevator car in proximity to the guide rail and is coupled to an actuation member for the safety brake. In the event that the safety brake is needed, such as in an overspeed condition, the friction brake is urged into contact with the guide rail producing a drag force. The drag force displaces the friction brake relative to the elevator car and simultaneously displaces the actuation member. The displacement of the actuation member triggers the safety brake against the guide rail braking the elevator car.

In an embodiment of the present invention the friction brake comprises an electromagnet producing an attraction force pulling it into contact with the guide rail to produce the drag force. In another embodiment the friction brake comprise a caliper having a coil actuator to maintain the caliper in an open position and a spring to bias brake linings against the guide rails to produce the dragging force.

The foregoing and other objects, features and advantages of the present invention will become more apparent in light of the following detailed description of the invention, as shown in the accompanying drawings.

BRIEF DESCRIPTION OF THE DRAWINGS

FIG. 2 is a perspective view in partial section of a ropeless governor and a wedge safety shown in FIG. 1;

FIG. 3 is a top plan view in partial section of the ropeless governor shown in FIG. 2;

FIG. 8 is a side plan view of the ropeless governor shown in FIG. 7;

FIG. 9 is a plan view in partial section of the ropeless governor shown in FIG. 8 within a mounting bracket; and FIG. 10 is a schematic representation of a control system of the ropeless governor system shown FIG. 1.

BEST MODE FOR CARRYING OUT THE INVENTION

Figure 1:
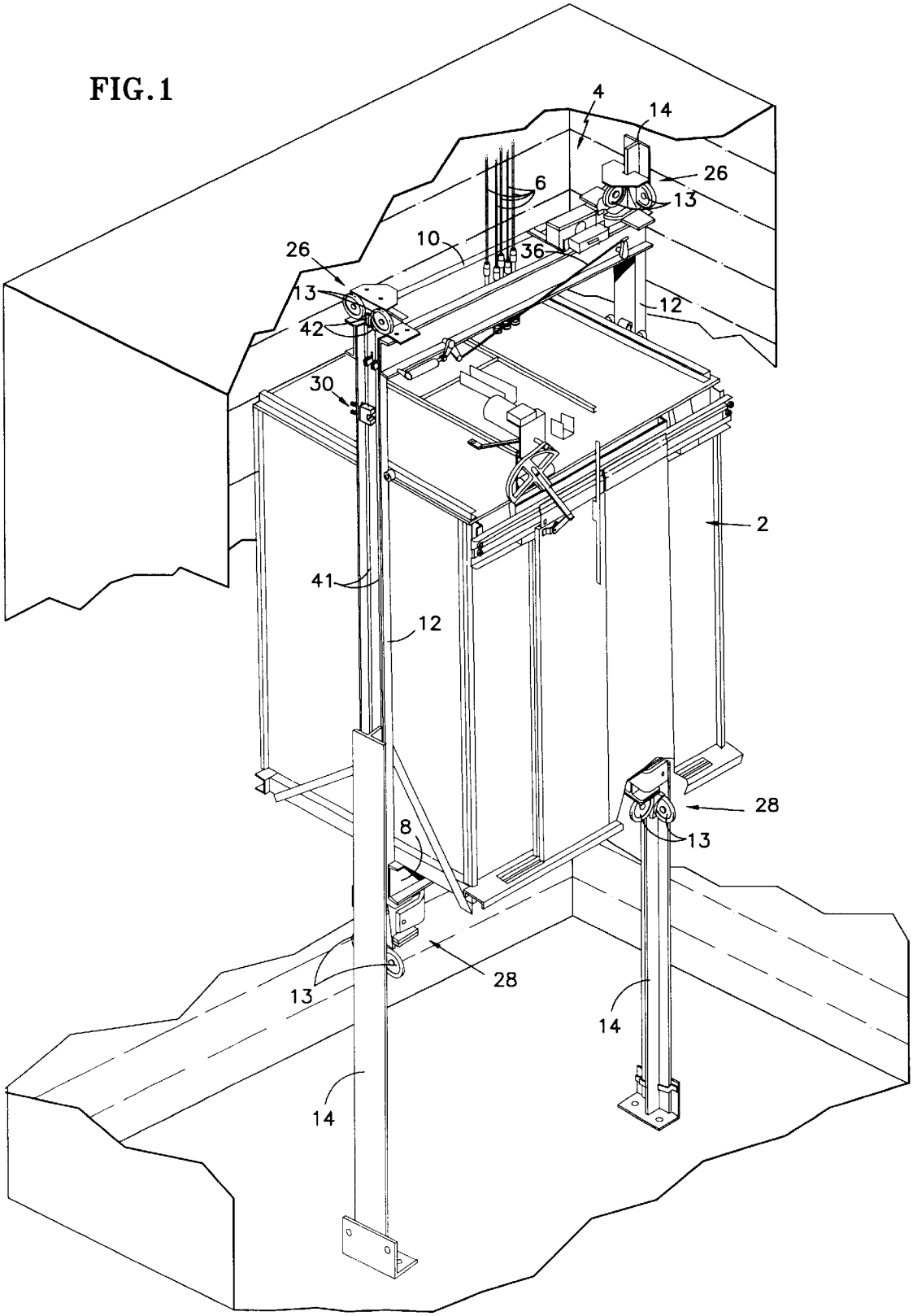
FIG. 1 is a perspective view of an elevator system employing the present invention.

FIG. 1 shows an actuator for an elevator safety in the form of a ropeless governor 30 of the present invention mounted to an elevator car 2 including sitting on a flame 4 which hangs from, and is moved by, ropes 6 connected to a motor (not shown). The car frame 4 includes a safety plank 8 on which elevator car 2 sits, two uprights 12 on either side of car frame 4 and a cross head 10 to which elevator ropes 6 are directly attached. On either side of car frame 4 is a guide rail 14 on which car frame 4 rides within rollers 13.

As will be more fully explained hereinbelow, in the event of an overspeed condition of elevator car 2, an actuator, or a ropeless governor 30, contacts and drags on rail 14 producing a force and pulling safety rods 41. Rods 41 in turn activate brakes 26, 28 by pulling wedges 42 vertically to pinch guide rail 14. The safety brakes, or safeties 26, 28 are similar to those in the prior art wherein the pinching force produces a progressive deceleration of the elevator car 2. In an overspeed event where elevator car 2 is running downwardly, activation of ropeless governor 30 will cause safety rods 41 to be pulled upwardly so as to activate safety brakes 28 on the bottom of car 2. In an overspeed event where elevator car 2 is running upwardly, activation of ropeless governor 30 will cause safety rods 41 to be pulled downwardly so as to activate safety brakes 26 on the top of car 2. Thus, the braking action is effective whether the safety rods 41 are moved up or down by activation of ropeless governor 30. It should be understood by those skilled in the art that the above-mentioned activation rods and safeties have various configurations including various tripping assemblies, wedge safeties, roller safeties and their equivalents. In addition, although the present invention is shown and described with respect to dual directional safeties it is within the scope of the present invention that a single direction safety may be activated by the present invention in an equivalent manner.

In FIGS. 1 and 2 a linkage 36 is used to connect the upper safeties 26 and lower safeties 28 on both sides of elevator car 2 to an actuator 30 such that vertical movement of the ropeless governor relative to the elevator car 2 will trigger the safeties 26 or 28 to brake the elevator car.

When ropeless governor 30 is activated, the safety rods 41 move vertically and trigger the wedge safety 26 or 28. Once triggered, the wedge safety 26 or 28 contacts the rail guide 14 and causes the elevator car 2 to be braked as described above. The braking action is effective whether the safety rods 41 are moved up or down.

Referring now to FIG. 2 there is shown a conventional safety 26 which is connected to ropeless governor 30 via electromagnet 31 and activation rod 41 by any conventional means. Magnet 31 functions as an electromagnetic friction brake wherein poles 32, 33 contact stem 15 of rail 14. Magnet poles 32, 33 may be tipped with case iron or other braking lining material, preferably comprising a magnetic material, and acting as friction faces. Rail 14 and stem 15 are preferably comprised of a ferrous or magnetic material. As will be described more fully hereinbelow, when magnet 31 of ropeless governor 30 activates during an overspeed condition, poles 32, 33 are pulled into contact with stem 15 of rail 14 moving left activation rod 41 (as viewed in FIG. 2) up or down depending on the direction of travel of the elevator car. Through links 43, 44, 45 right activation rod 41 is similarly translated pulling wedges 42 of safety 26 or safety 28 (FIG. 1), again depending on direction of travel. In addition, safety brakes 26, 28 on the opposite side of elevator car 2 are activated through linkage 44 and linkage 36 as described hereinabove.

With reference to FIGS. 2 and 3 ropeless governor 30 is mounted to leg 16 of upright 12 via guide pins 34 disposed through slot 17. Springs 35 are disposed on guide pins 34 between leg 16 and adjustment nut 36 and bias magnet 31 away from stem 15 such that a predetermined gap represented by 37 is maintained between poles 32, 33 and stem 15.

In the embodiment of the present invention shown in FIGS. 2 and 3, gap 37 is maintained by guides 34 and springs 35 and is established by nut 36 to be from about 2 mm to about 6 mm and the spring constant of spring 35 is on the order of 10 N/mm. With reference to FIG. 2 the force required to operate activation rod 41 is about 400 N. Assuming a coefficient of friction of 0.2 for cast iron for poles 32, 33 and stem 15, a force of about 2000 N is required between the poles and the stem. This force is achieved by using electromagnet 31 while maintaining gap 37 through an iterative computational process as set forth hereinbelow. The MATLAB computer code for the computation is as follows and is directed at a powerful lifting type electromagnet intended for short term intermittent duty. The dimension of the magnet are indicated together with the flux density B0=0.817 tesla.

```
govmag1.m
%
% APPLICATION IS TO ROPELESS GOVERNOR
8/4/98
%   COMPUTATIONS RELATED TO
ELECTROMAGNETS -
%   MKS units
clear
% sf= scale factor permits rapid scaling of dimensions
sf=1.;
L = .035*sf                    ;% STACK HEIGHT
D = .05*sf                     ;% HEIGHT OF MAGNET CORE (.075
nom)
WP = .035*sf                   ;% POLE WIDTH
WC = .06*sf                    ;% WIDTH OF COIL
% TOTAL WIDTH OF MAGNET STRUCTURE =
WC+2*WP
GAP =.005                      ;% MAXIMUM AIRGAP
RHOI =7700                     ;% MASS DENSITY OF IRON IN
KG/M^3
RHOC =8890                     ;% EFFECTIVE MASS DENSITY
OF COPPER WINDING COPPER SG=8.89
G=9.8                          ;% ACCELERATION OF GRAVITY
SIGMAC =5.8E+07                ;% EFFECTIVE CONDUCTIVITY
OF COPPER IDEAL=5.8E7
B0 = 0.8166                    % WORKING VALUE OF FLUX
DENSITY IN GAP
NTURN=484/1                    ;% NUMBER OF TURNS (484
nom)
PACK=.5                        ;% PACKING FACTOR FOR
WINDING
MU0=pi*4e-7;
gap =.00008:.00002: .002;
gapnum=length(gap);
%
text1=sprintf('L,D=%7.3f%7.3f',L,D);
text2=sprintf('WP,WC=%7.3f%7.3f',WP,WC);
text3=sprintf('N,PACK__=%7.3f%7.3f',NTURN,PACK);
%FLIFT IS THE FORCE OF ATTRACTION IN
NEWTONS
flift=B0^2*WP*L/MU0;
%
%
MASSI=(2*D+WC)*WP*L*RHOI;
MASSC=((WC+WP)*(L+WC)-L*WP)*2*(D-
WP)*RHOC*PACK;
MASS=MASSI+MASSC;
MASSI
MASSC
%
%WEIGHT IN KG IS
wgtkg = MASS;
```

-continued

```
text5=sprintf('F (N), WT (KG) =%6.1f%6.1f',flift,wgtkg);
%
%THE WINDING RESISTANCE IS
R=2*NTURN^2*(WP+WC+L)/(PACK*(D-
WP)*WC*SIGMAC);
%
%THE FORCE CONSTANT IS
(F=CONSTANT*(I/GAP)^2)
fconst=MU0*WP*L*NTURN^2/4;
disp('force constant in N-mm^2/A^2')
disp(fconst*1e6)
%
% LEAKAGE INDUCTANCE IS ESTIMATED
KL=MU0*NTURN^2;
% inside leg to leg
L1=KL*L*(D-WP)/(3*WC);
%
% off pole ends
L2=KL*L*WP/(WC+WP);
%
% off sides (both sides)
L3=KL*2*(D-WP)*WP/(3*(WC+WP));
%
% off outside
L4=KL*L*(D-WP)/(3*(WC+2*WP+D/2));
%
% TOTAL ESTIMATE OF LEAKAGE INDUCTANCE
Lleak=L1+L2+L3+L4;
;
for np=1:gapnum;
%THE WINDING INDUCTANCE IS
%
Lw(np)=2*fconst/gap(np);
%
%I IS THE CURRENT DENSITY IN THE WINDINGS IN
A/M^2
I(np) = 2 * B0 * gap(np) / (MU0 * NTURN);
%
%POWER TO THE WINDING IS COMPUTED
power(np) =I(np)^2*R;
%
%magnet time constant tau
tau(np)=(Lw(np)+Lleak)/R;
end;
gapmm=gap*1000;
% wire computations*************************************
%
% coil window area in sq-mm
acoil=(D-WP)*WC*1E+6;
awire=acoil*PACK/NTURN;
disp('wire cross-sectional area in sq-mm')
disp(awire)
pause
clf;
axis;
subplot(221),plot(gapmm,I/awire,'r');
title('CURRENT DENSITY VS GAP');
%xlabel('gap (mm)');
ylabel('J (A/mm^2)');
Ltot=1000*(Lw+Lleak);
grid
subplot(222),plot(gapmm,Ltot,gapmm,Lw*1000');
grid
%xlabel('gap (mm)');
ylabel('Inductance (mH)');
%
title('AIRGAP & TOTAL L VS GAP');
subplot(223),plot(gapmm,power);
grid
title('POWER VS GAP')
xlabel('gap (mm)');
ylabel('Power (W)');
gap_nominal=.001
index1=find(gap>(gap_nominal-.00001));
gap(index1(1))
LMH=Lw(index1(1))*1000;%
text4=sprintf('LmHairg(1mm),R=%7.3f%7.3f',LMH,R);
%text6=sprintf('Kf(N-m^2/A^2) %9.5g',fconst);
text6=sprintf('Bo (Tesla), ScaleFactor=
```

-continued

```
%7.3f%7.3f',B0,sf);
text7=sprintf('wire area(mm2)=%9.5g',awire);
text8=sprintf('Lleak(Mh)=%7.3f', Lleak*1000);
subplot(224),plot([0 0], [0],'w');
axis([0 1 0 1]);
title('DATA FOR U-SHAPED ELECTROMAGNET');
text(.05,.85,text1);
text(.05,.74,text2);
text(.05,.63,text3);
text(.05,.52,text4);
text(.05,.41,text5);
text(.05,.30,text6);
text(.05,.19,text7);
text(.05.08,text8);
%
```

Figure 4:
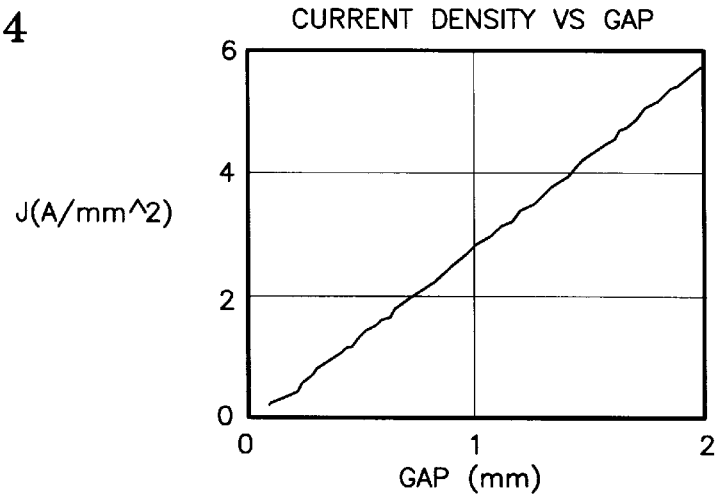
FIG. 4 is a graphical representation of operational parameters for an embodiment of the present invention.
Figure 5:
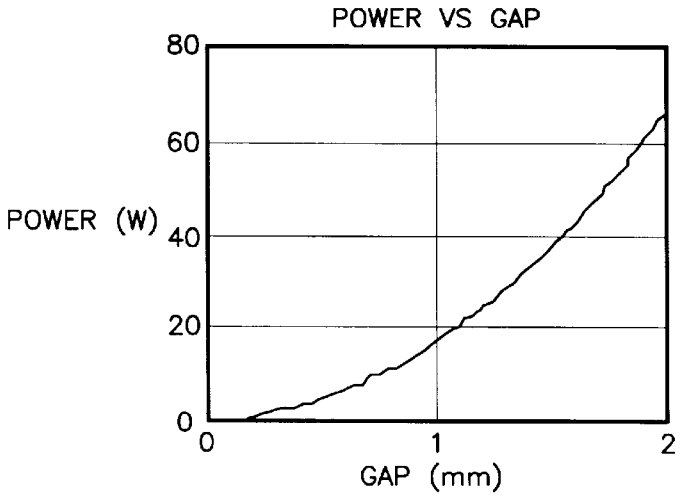
FIG. 5 is a graphical representation of operational parameters for an embodiment of the present invention.
Figure 6:
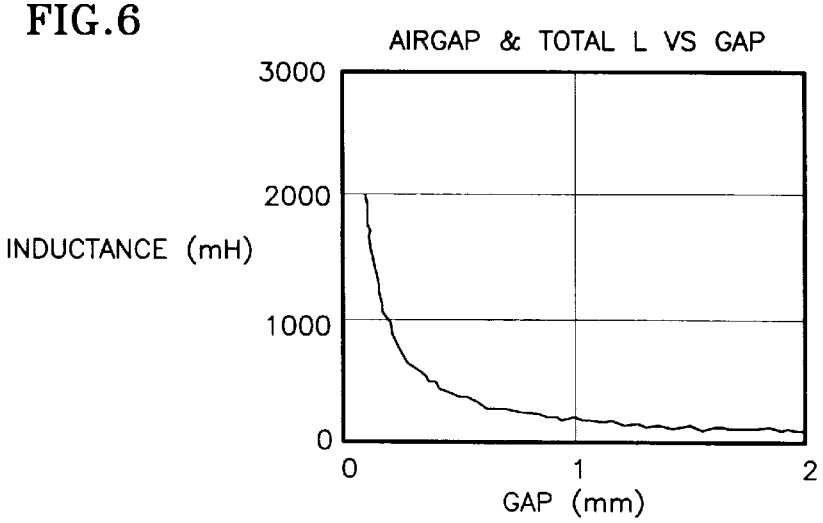
FIG. 6 is a graphical representation of operational parameters for an embodiment of the present invention.

The relationships set forth in FIGS. 4, 5, and 6 were derived using the above computer code computations and were used to design the embodiment shown in FIGS. 2 and 3. Electromagnet 31 comprises a U-shaped electromagnet wherein the force obtained at poles 32, 33 (FIG. 2) varies directly with current squared (current supplied to the magnet) and varies inversely with gap 37 squared. It was assumed in the computations above that the magnet is as much as 6 mm from the rail face when it is energized and has an effective airgap of 0.5 mm when the pole faces are in contact with the rail due to the fact that the material of the magnet has an inherent permeability as is known.

The current requirements of electromagnet 31 are expressed in terms of current density (J) expressed in A/mm^2 (FIG. 4). In the computations above electromagnet 31 comprises 484 turns of wire having a cross section of 0.92 mm^2 with a packing factor of 0.5. The design force for electromagnet 31 was set at 650 N at a flux density of 0.817 Tesla. When gap 37 is set at approximately 6 mm a force of 20 N is required to overcome frictional and bias forces of springs 35 in order to initiate movement of electromagnet 31 toward stem 15. With force (F) expressed in Newtons and power (P) expressed in Watts, the force constant (K1) and power constant (K2) for electromagnet 31 are derived from the computations and graphical data set forth in FIGS. 4, 5 and 6 as follows:

$$F=K1*(J/G)^2;$$

and $$P=K2*J^2$$

Wherein G is the gap 37 and J is current density as described above.

With G=2 mm, J=5.8 A/mm^2 and P=65 W. Substitution into the above relations yields:

K1=77.3 and K2=1.93

The required current density to initiate movement of electromagnet 31 with G=6 mm and F=20 is J=3.05 A/mm^2. The associated power is P=18 W.

The holding current density and power required for pulling activation rod 41 are derived with G=0.5 mm and F=2000 N. and are J=2.54 A/mm^2 and P=12.5 W. Knowing the current density and power requirements the flux density (B) for the embodiment shown may be estimated. The flux density varies directly with the force as follows:

$$B=K3*F$$

As stated herein above at F=650 N the flux density B=0.817 Tesla. Thus the first iteration of the above computations yields the flux density constant K3=1.26 e−3 and thereby For F=2000 N the flux density B=2.52 Tesla. Since a flux density of 2.52 Tesla is extraordinarily high a second iteration of the computations is required to provide an industrially achievable embodiment of the present invention with flux densy below or approximately equal to 2 Tesla. In the second iteration an embodiment was achieved setting the drive current approximately twice that used earlier having a normal force of 1600 N with a current density of approximately 5 A /mm^2 and a corresponding power of 48 W. The weight of such a magnet is approximately 2.5 kg. and has a relatively inexpensive cost.

The present invention includes the use of an actuator 30 disposed on each side of elevator car 2 and further includes a pair of ropeless governors disposed on either side of car 2 wherein each ropeless governor operates one of the activation rods. In addition, it is within the scope of the present invention that multiple U-type magnets may be used in periodic structure in order to generate sufficient force against rail 14 to activate any particular type of safety.

Figure 7:
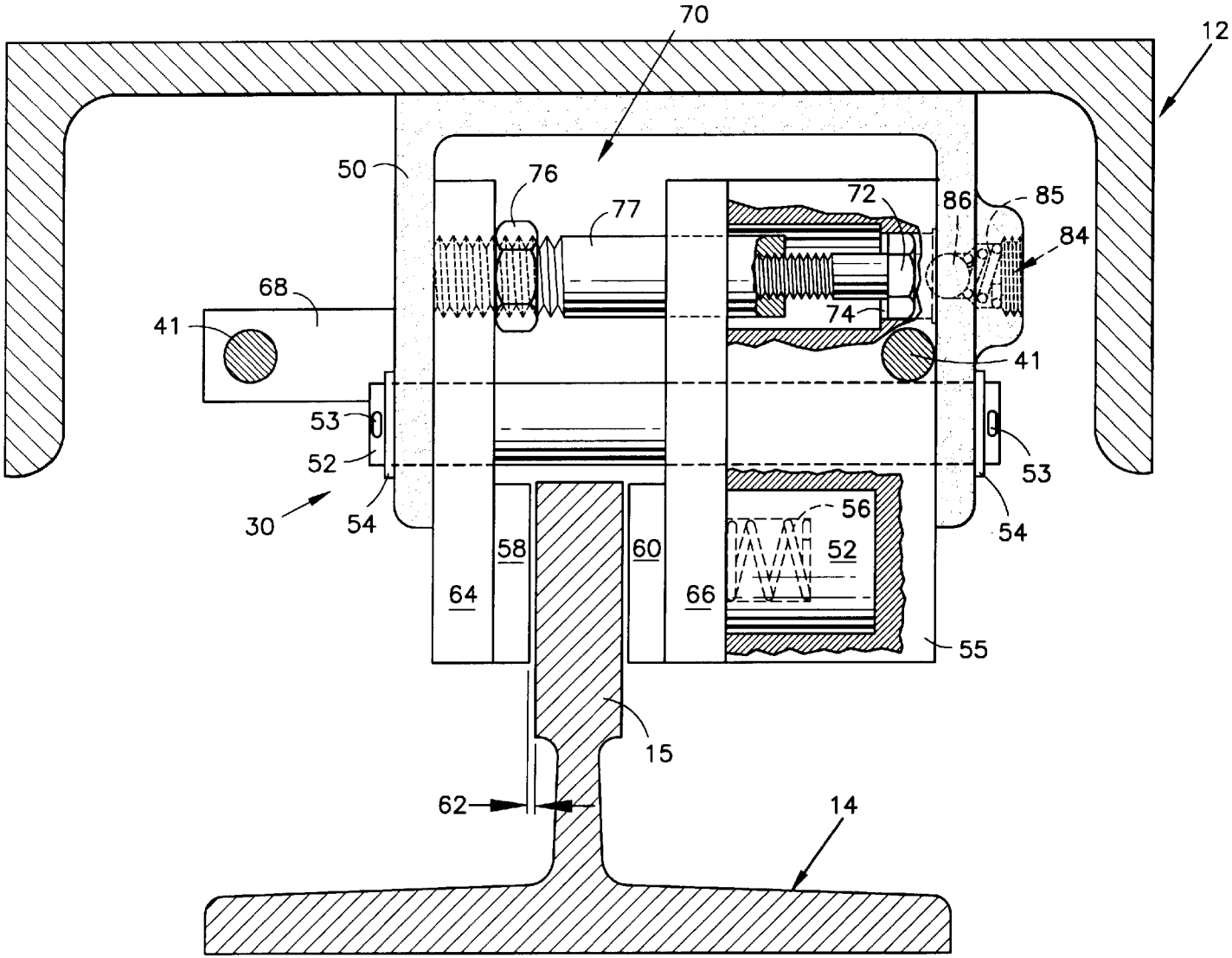
FIG. 7 is a top plan view in partial section of an alternative embodiment of the ropeless governor shown in FIG. 1.

Referring now to FIG. 7, an alternative embodiment of ropeless governor 30 is shown in the form of a caliper mounted to upright 12 by mounting bracket 50 on guiding pins 52 and includes a coil activated At actuator 52 and spring 56 which cooperate to alternatively apply and release brake linings 58, 60 against stem 15 of rail 14. Guiding pins 52 are held in place within mounting bracket 50 by cotter pins 53, or by any suitable equivalent, with washers 54 positioned therebetween. Electrical power is supplied to actuator 52 under normal operation of elevator car 2 to maintain brake linings 58, 60 at a predetermine distance, or gap, represented by 62, from stem 15 by urging the armature plate 66 against magnet block 55. Electrical power is interrupted to actuator 52 during an overspeed event and spring 56 provides a biasing force against armature plate 66 reacting against bracket 50 and in turn end plate 64 thereby urging friction faces, in the form of brake linings 58, 60, against stem 15. Spring 56 is sized so as to provide enough force to translate activation rods 41 to apply safeties 26, 28 (FIG. 1) similar to the alternative embodiment as described hereinabove. Activation rods 41 may be mounted directly to ropeless governor 30 or by a bracket 68 by any suitable means.

Referring to FIGS. 7 and 8, gap 62 is adjusted and maintained by air gap adjuster 70 which is comprised of mounting bolts 72 captured within bosses 74 and threaded within inside threads of threaded spacer 77. Threaded spacer 77 is slidably disposed within armature 66 and includes external threads which are threadably engaged within end plate 64 and further includes lock nut 76 threadably disposed thereon. Rotation of threaded spacer 76 allows gap 62 to be increased or decreased in the open position while actuator 52 is energized. Once gap 62 is adjusted to a satisfactory level lock nut 76 is tightened against end plate 64 thereby fixing the position of brake linings 58, 60 relative to stem while coil is energized.

Referring to FIGS. 1, 7 and 9 it is shown that ropeless governor 30 travels along with elevator car 2. When an overspeed condition is reached, power is interrupted to actuator 52 and spring 56 biases brake linings 58, 60 against stem 15 causing a drag action against rail 14 sufficient to actuate rods 41 as described hereinabove. As best shown in FIG. 9 ropeless governor 30 is displaced, and rods 41 thereby, during the drag action within mounting slot 80 from the position shown in solid to the position shown in phantom. As ropeless governor 30 is displaced within slot 80 activation rods 41 are pulled to activate safeties 26, 28. An upward traveling overspeed condition is shown by way of example in FIG. 9 wherein ropeless governor 30 is displaced within slot 80 in a downwardly direction pulling activation rods 41 and engaging wedges 42 of safeties 26 mounted to the top of elevator car 2. The length that ropeless governor 30 is displaced within slot 80 is represented by 82 and equates to the distance required to activate wedges 42 to fully engage safeties 26. In a downwardly traveling overspeed condition ropeless governor 30 is displaced upwardly within slot 80.

A ball detent 84 as best shown in FIG. 7 is an example of a device to position ropeless governor midway within slot 80 or alternatively slot 17 (FIG. 2). Ball detent 84 is attached to bracket 50 and includes spring 85 biasing ball 86 into spherical depression 87 (FIG. 8). During normal elevator operation ball detent 84 properly positions ropeless governor 30 within slot 80 and also prevents triggering of safeties 26, 28 (FIG. 1) caused by vibration or inadvertent dragging of brake linings 58, 60 against stem 15. It is within the scope of the present invention that other static positioning devices may be used such as a spring system, a dog and pawl, or other suitable equivalent.

A control scheme for ropeless governor 30 is shown generally as 90 in FIG. 10. Safety controller 91 comprising a microprocessor receives power from power module 92 and a speed signal from speed sensor 93. The power represented by 94 sent by power module 92 may comprise standard building current and also include a battery backup. Speed sensor 93 may comprise any known device which is capable of producing an output speed signal represented by 95 corresponding to the speed of elevator car 2. Safety controller 91 determines whether an overspeed condition exists utilizing software, a comparator or other equivalent means. Safety controller 91 compares speed signal 95 to a threshold voltage value corresponding to an overspeed condition. For example, a typical elevator may have a rated speed of 15 m/s and an overspeed condition is typically 120%+/−5% of the rated speed. When the voltage of signal 95 corresponds to a threshold value greater than the predetermined overspeed value, safety controller 91 outputs a triggering signal represented by 96 to operate ropeless governors 30 and safeties 26, 28 as described hereinabove. Safety controller 91 operates during a power outage or when the building electrical power is turned off, by activating ropeless governor 30 to engage rail 14 only after the time required to perform an emergency stop. If car 2 does not stop in the normal stopping distance or a condition occurs which causes the car to move after it has stopped, the ropeless governor system will engage the safeties as described hereinabove.

While preferred embodiments have been shown and described, various modifications and substitutions may be made thereto without departing from the spirit and scope of the invention. Accordingly, it is to be understood that the present invention has been described by way of illustrations and not limitation.

We claim:

1. A selectively operable safety brake apparatus on an elevator car disposed for vertical motion between guiderails in a hoistway, comprising:

a safety brake disposed on the car and adapted to be wedged against one of the guiderails when moved from a non-braking condition into a braking condition;

a rod disposed on the car for moving said safety brake between said braking and non-braking conditions; and a friction brake attached to said rod and disposed on said car adjacent said one guiderail and moveable between a rail-engaging position and a rail-non-engaging position, said friction brake, when in said rail-engaging position contemporaneously with motion of said car, moving said rod in a direction opposite to the motion of the car to thereby move said safety brake from said non-braking condition into said braking condition;

characterized by the improvement comprising:

a speed sensor for providing a speed signal indicative of the speed of car motion;

a safety controller for comparing the speed represented by said speed signal to speed represented by a threshold signal indicative of an overspeed condition, and for providing a trigger signal in response to said speed signal indicating a speed in excess of said overspeed condition;

resilient means for urging said friction brake into said rail-engaging position; and an electromagnet for normally holding said friction brake in said rail-non-engaging position against the urging of said resilient means, and for allowing said resilient means to move said friction brake into said rail-engaging position in the presence of said trigger signal.

2. A safety brake according to claim 1 wherein said friction brake has a pair of rail contacting surfaces.

3. A safety brake according to claim 2 wherein both of said rail contacting surfaces are on the same side of the rail.

4. A safety brake according to claim 2 wherein one of said rail contacting surfaces is on one side of said rail, and the other of said rail contacting surfaces is on the other side of said rail.

* * * * *